US005181988A

United States Patent [19]

Akutsu et al.

[11] Patent Number: 5,181,988

[45] Date of Patent: Jan. 26, 1993

[54] METHOD FOR PREVENTING THE DISCOLORATION OF PAPER AND PAPER TREATED TO PREVENT DISCOLORING

[75] Inventors: Mitsuo Akutsu, Tokyo; Syuji Iwakura, Saitama, both of Japan

[73] Assignee: Asahi Denka Kogyo Kabushiki Kaisha, Tokyo, Japan

[21] Appl. No.: 715,042

[22] Filed: Jun. 12, 1991

Related U.S. Application Data

[63] Continuation of Ser. No. 370,031, Jun. 21, 1989, abandoned.

[30] Foreign Application Priority Data

Jul. 8, 1988 [JP] Japan ..... 63-170081

[51] Int. Cl.[5] ..... D21H 21/32; D21H 23/04

[52] U.S. Cl. ..... 162/135; 162/80; 162/158; 162/181.2; 106/287.29; 427/395

[58] Field of Search ..... 162/150, 160, 181.2, 162/142, 80, 135, 158, 159; 106/287.29; 427/395

[56] References Cited

U.S. PATENT DOCUMENTS

| | | | |
|---|---|---|---|
| 2,208,574 | 7/1940 | Fleck | 162/142 |
| 2,226,841 | 12/1940 | Barnhart | 162/181.2 |
| 3,536,578 | 10/1970 | Brundige et al. | 162/160 |
| 3,619,355 | 11/1971 | Silberman | 162/160 |
| 4,820,307 | 4/1989 | Welch et al. | 8/116.1 |

FOREIGN PATENT DOCUMENTS

| | | | |
|---|---|---|---|
| 5468402 | 11/1977 | Japan . | |
| 0586214 | 12/1977 | U.S.S.R. | 162/84 |

*Primary Examiner*—Steve Alvo

*Attorney, Agent, or Firm*—Frishauf, Holtz, Goodman & Woodward

[57] ABSTRACT

A process for treating paper to prevent discoloration when exposed to light which comprises adding 1% to 10% by weight of hypophosphorous acid or its salt based on the paper at any stage during or after paper making and maintaining said hypophosphorous acid or its salt therein. The invention also provides paper which contains hypophosphorous acid or its salt to prevent discoloration when exposed to light.

8 Claims, No Drawings

METHOD FOR PREVENTING THE DISCOLORATION OF PAPER AND PAPER TREATED TO PREVENT DISCOLORING

This application is a continuation of application Ser. No. 07/370,031, filed Jun. 21, 1989, now abandoned.

BACKGROUND OF THE INVENTION

1. Field of the Invention

This invention relates to a process for preventing the discoloration of paper and paper prevented from discoloring.

More particularly, it relates to a process for preventing the discoloration, in particular, caused by irradiation of paper with light which comprises adding or applying hypophosphorous acid or its salt to the paper at any step during or after papermaking, and to paper prevented from discoloring by adding or applying hypophosphorous acid or its salt thereto.

2. Description of the Prior Art

It is widely known that paper is made by mechanically or chemically treating a vegerable material such as wood to thereby give a pulp such as mechanical, chemical, semichemical, wastepaper, hemp or linter pulp and feeding said pulp into a paper machine.

When an unbleached pulp is fed to a paper machine as such, the obtained paper has an unsatisfactory whiteness. In such a case, the pulp may be bleached through oxidating by using, for example, chlorine, hypochlorites, chlorine dioxide, hydrogen peroxide or oxygen or through reduction by using, for example, hydrosulfite or aqueous sulfurous acid, if desired.

A papermaking process comprises a preparation step where a pulp or a mixture thereof is ground and chemicals such as a sizing agent or a filler are added thereto, a papermaking step where the above mixture is treated with various papermachines, dehydrated, dried and glazed, and a conversion and finishing step where a coating suitable for the purpose is applied onto the surface of the resulting paper. Thus a paper having the desired properties is obtained.

Although the paper thus obtained has a certain whiteness immediately after the production, it suffers from serious discoloration when exposed to sunlight involving UV light. Such a discoloration occurs regardless of the type of the pulp or bleaching.

Recently, the application of so-called high-yield pulps has been more and more increasing in order to efficiently utilize wood resources and to lower waste matters. These high-yield pulps contain a large amount of lignin and thus suffer from significant discoloration upon irradiation with light. This causes a serious problem when these high-yield pulps are employed not only alone but also as a mixture with chemical pulp(s).

It has been attempted to suppress the discoloration upon irradiation with light. For example, it is proposed to add an UV absorber to paper. However this method is disadvantageous in that a large amount of an expensive UV absorber is required and the UV absorber generally has a yellow color, thus imparting an undesirable color to the paper.

It was reported that a low molecular weight mercapto compound such as thioglycerol or thioglycol was effective in the prevention of the discoloration of high-yield pulps caused by light (cf. Tappi Journal, Nov. 1987, 117–122). However this method was inavailable in practice, since it could not give any satisfactory effect and, furthermore, the mercapto compound to be used had an offensive odor.

Thus it has been eagerly desired to establish a process for preventing the discoloration of paper without exerting any undesirable effects on other properties of the paper.

U.S.S.R. Patents No. 485178, No. 542775, No. 697617 and No. 857328 disclose that the use of a hypophosphite in the production of pulp enables the Production of the pulp at a high yield. However it is obvious that the hypophosphite used during the production of the pulp would never substantially remain in the paper. Furthermore, none of these patents discloses an effect of preventing the discoloration of the paper after the completion of the papermaking.

SUMMARY OF THE INVENTION

Under these circumstances, the present inventors have attempted to establish a process for preventing the discoloration of paper caused by light. As a result, they have found that the discoloration of paper can be effectively prevented by adding or applying hypophosphorous acid or its salt to the paper.

Accordingly, the present invention, which has been completed based on the above finding, provides a process for preventing the discoloration of paper which comprises adding or applying hypophosphorous acid or its salt to paper at any step during or after papermaking, and paper prevented from discoloring by adding or applying hypophosphorous acid or its salt thereto.

The process for preventing the discoloration of paper according to the present invention makes it possible to effectively prevent the discoloration of paper caused by light without exerting any undesirable effect on other properties of the paper.

The paper according to the present invention is remarkably prevented from discoloring caused by light.

DETAILED DESCRIPTION OF THE INVENTION

The hypophosphorous acid to be used in the present invention is represented by the following general formula:

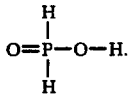

Examples of the hypophosphite to be used in the present invention include those of a metal such as lithium, sodium, potassium, rubidium, cesium, beryllium, magnesium, calcium, strontium, barium, zinc, cadmium, aluminum, manganese, nickel, gallium, germanium, tin, organotins such as mono- or dimethyltin, mono- or dibutyltin or mono- or dioctyltin, lead, antimony and bismuth; ammonium hypophosphite; hypophosphites of an aliphatic or aromatic amine such as mono-, di- or trimethylamine, mono-, di- or triethylamine, mono-, di- or tributylamine, mono-, di- or trioctylamine, mono-, di- or triethanolamine, mono-, di- or triisopropanolamine, methyldiethanolamine, stearyldiethanolamine, hexamethylenediamine, ethylenebis (diethanolamine), diethylenetriamine, triethylenetetramine, hexamethylenetetramine, benzylamine, aniline, diethylaniline and diethanolaniline; hypophosphites of a heterocyclic amine such as pyridine, lutidine, toluidine, pyrimidine, pyrazine, piperidine, N-methylpiperidine, piperazine, hexahydrotriazine, morpholine, pyrrole, pyrroline, pyrrolidine, imidazole, imidazoline, imidazolidine, pyrazole, pyrazolidine and indole; hypophosphites of a polymeric amine such as polyvinylpyridine, polydiallylamine and polyethyleneimine; quaternary ammonium hypophosphites such as tetramethyl-, trimethylethyl-, triethylmethyl-, tributylmethyl-, tetrabutyl-, octyldimethylhydroxyethyl-, triphenylmethyl- and tribenzylmethylammonium hypophosphites; and sulfonium hypophosphites such as triethylsulfonium hypophosphite.

Among these compounds, hypophosphites of the group Ia or IIa metals and organic amine hypophosphites are preferable, since they are readily available and hardly toxic.

The amount of the hypophosphorous acid or its salt to be added or applied is not particularly limited. It may be determined depending on the desired level of the prevention of the discoloration or the paper to be treated. Generally speaking, the hypophosphorous acid or its salt may be added in an amount of 0.1 to 20% by weight, preferably 1 to 10% by weight, based on the paper in terms of dry matter.

The method and time for adding or applying the hypophosphorous acid or its salt are not particularly limited. Namely, the hypophosphorous acid or its salt may be added in the preparation step where pulp is ground and various chemicals such as a sizing agent or a filler are added thereto. Alternately a solution of the hypophosphorous acid or its salt may be added to paper or the paper may be impregnated with said solution at any step in the papermaking process wherein the paper is dehydrated, dried and calendered or in the conversion and finishing step wherein a coating is applied to the surface of the paper. Alternately, a solution of the hypophosphorous acid or its salt may be sprayed on the paper after the completion of the papermaking process.

The hypophosphorous acid and most of its salts are either soluble or highly dispersible in water, which brings about an advantage that they can be added or applied in the form of an aqueous solution without requiring any particular procedure.

The paper to be treated according to the process of the present invention is not particularly restricted. Namely, the present invention can be effectively applied to any paper obtained from any pulp. It is particularly effective on those obtained from pulps containing lignin, such as mechanical or semichemical pulps.

The pulp to be used in the papermaking according to the present invention may be either bleached or not.

Furthermore, the paper prevented from discoloring according to the present invention may contain various papermakers' chemicals commonly used in the art. Furthermore, the paper may be optionally coated.

Examples of the papermakers' chemicals include rosin, petroleum resin, synthetic resin and wax sizing agents; starch, polyvinyl alcohol and polyacrylamide surface improvers; polyacrylamide, carboxymethylcellulose, urea resin, melamine and epoxidized polyamidepolyamine resin strengthening agents; and polyethyleneimine and polyacrylamide yield enhancers.

The hypophosphorous acid or its salt to be used in the present invention is effective in preventing the discoloration of paper regardless of the addition of these chemicals.

EXAMPLES

To further illustrate the present invention, and not by way of limitation, the following Examples will be given.

EXAMPLE 1

A 10% aqueous solution of hypophosphorous acid or a hypophosphite was applied to a newsprint of a basis weight of 46 g/m$^2$ at a dry coating weight of 2.5 g/m$^2$ followed by drying.

Then the newsprint was exposed to sunlight for one week and the degree of the discoloration was expressed by the difference in the yellownesses measured with a Hunter's colorimeter (ASTM D1925) before and after the exposure.

For comparison, a paper treated with a solution containing no hypophosphorous acid and another one treated with a solution wherein thioglycerol was used instead of the hypophosphorous acid were also tested.

Table 1 shows the results.

TABLE 1

| No. | Hypophosphorous acid or its salt | Yellowness after 3 days | Yellowness after 7 days |
|---|---|---|---|
| Comp. Ex. | | | |
| 1-1 | none | 13.7 | 25.0 |
| 1-2 | thioglycerol | 10.2 | 20.5 |
| Ex. | | | |
| 1-1 | hypophosphorous acid | 7.5 | 13.4 |
| 1-2 | sodium hypophosphite | 6.8 | 12.7 |
| 1-3 | potassium hypophosphite | 7.3 | 13.1 |
| 1-4 | calcium hypophosphite | 7.7 | 13.6 |
| 1-5 | magnesium hypophosphite | 7.6 | 13.8 |
| 1-6 | stearyldiethanolamine hypophosphite | 8.6 | 15.2 |

EXAMPLE 2

A given amount of a 10% aqueous solution of sodium hypophosphite was applied to a newsprint of a basis weight of 46 g/m$^2$ followed by drying.

Then the newsprint was irradiated in a fade meter at 83° C. for 3 hours and then the change in the yellowness was examined.

Table 2 shows the results.

TABLE 2

| No. | Amount of sodium hypophosphite | Change in yellowness |
|---|---|---|
| 2-1 | none | 16.8 |
| 2-2 | 1 g/m$^2$ | 11.4 |
| 2-3 | 2 g/m$^2$ | 8.9 |
| 2-4 | 3 g/m$^2$ | 7.2 |
| 2-5 | 4 g/m$^2$ | 6.3 |
| 2-6 | 5 g/m$^2$ | 6.0 |

EXAMPLE 3

A chemithermomechanical pulp having a whiteness of 77.0, which had been bleached with hydrogen preoxide, was dispersed in a 10% solution of sodium hypophosphite in distilled water at a concentration of 1%. From this dispersion, a handmade paper sheet was produced in a conventional manner and then dehydrated to a moisture content of 50%. Next, it was air-dried and thus a handmade paper sheet of a moisture content of 5% was obtained.

This sheet was irradiated in a fade meter at 83° C. and the change in the yellowness was examined.

For comparison, another sheet produced without using sodium hypophosphite was also tested.

Table 3 shows the results.

TABLE 3

| Irradiation time | Yellowness | |
|---|---|---|
| | Na hypophosphite-contg. sheet | Na hypophosphite-free sheet |
| 30 min | 1.1 | 5.7 |
| 1 hr | 3.7 | 7.4 |
| 2 hr | 5.9 | 12.6 |
| 3 hr | 7.5 | 16.3 |
| 5 hr | 10.3 | 22.4 |

The results of Examples 1 to 3 obviously indicate that the addition or application of the hypophosphorous acid or its salt to paper can remarkably prevent the paper from discoloring caused by light.

What is claimed is:

1. A process for treating paper which comprises adding to paper from 1 to 10% by weight of hypophosphorous acid or its salt based on the paper in terms of dry matter in the paper by spraying onto said paper said hypophosphorous acid or its salt after papermaking to provide a treated paper containing an effective amount of said hypophosphorous acid or its salt to prevent discoloration of the paper when exposed to light.

2. The process for treating paper as claimed in claim 1, wherein said hypophosphorous acid or its salt is added in an amount of from 2 $g/m^2$ to 5 $g/m^2$ of the paper in terms of dry matter.

3. The process for treating paper as claimed in claim 1, wherein said salt of hypophosphorous acid is one or more salts selected from the group consisting of hypophosphites of group Ia or IIa metals and organic amine hypophosphites.

4. The process for treating paper as claimed in claim 1 wherein said hypophosphorous acid or its salt which is incorporated in said paper is selected from the group consisting of hypophosphorous acid, sodium hypophosphite, potassium hypophosphite, calcium hypophosphite, magnesium hypophosphite, and stearyldiethanolamine hypophosphite.

5. The process for treating paper as claimed in claim 2, wherein said hypophosphorous acid or its salt is selected from the group consisting of hypophosphorous acid, sodium hypophosphite, potassium hypophosphite, calcium hypophosphite, magnesium hypophosphite, and stearyldiethanolamine hypophosphite.

6. The process for treating paper as claimed in claim 1, wherein said hypophosphorous acid or its salt is in the form of an aqueous solution which is added to said paper and the paper is then dried.

7. The process for treating paper as claimed in claim 4, wherein said hypophosphorous acid or its salt is in the form of an aqueous solution which is added to said paper and the paper is then dried.

8. The process for treating paper as claimed in claim 5, wherein said hypophosphorous acid or its salt is in the form of an aqueous solution which is added to said paper and the paper is then dried.

* * * * *